US010377152B1

(12) United States Patent
Wu

(10) Patent No.: US 10,377,152 B1
(45) Date of Patent: Aug. 13, 2019

(54) MEDIA TRANSPORTS

(71) Applicant: Xerox Corporation, Norwalk, CT (US)

(72) Inventor: Jin Wu, Pittsford, NY (US)

(73) Assignee: XEROX CORPORATION, Norwalk, CT (US)

( * ) Notice: Subject to any disclaimer, the term of this patent is extended or adjusted under 35 U.S.C. 154(b) by 13 days.

(21) Appl. No.: 15/898,017

(22) Filed: Feb. 15, 2018

(51) Int. Cl.
*B65H 5/02* (2006.01)
*B41J 11/00* (2006.01)
*B65H 5/22* (2006.01)
*B41J 11/02* (2006.01)

(52) U.S. Cl.
CPC ..... *B41J 11/007* (2013.01); *B41J 11/0085* (2013.01); *B41J 11/02* (2013.01); *B65H 5/224* (2013.01); *B65H 2404/27* (2013.01); *B65H 2404/28* (2013.01); *B65H 2801/03* (2013.01)

(58) Field of Classification Search
CPC ..... B65H 2404/27; B65H 2404/28; B65H 2404/283
See application file for complete search history.

(56) References Cited

U.S. PATENT DOCUMENTS 4,379,301 A 4/1983 Fischbeck
4,386,358 A 5/1983 Fischbeck
4,734,705 A 3/1988 Rezanka et al.
5,997,974 A 12/1999 Schlueter, Jr. et al.
6,079,814 A 6/2000 Lean et al.
6,106,762 A 8/2000 Agur et al.
6,165,670 A * 12/2000 Yu ..... B29C 71/02 264/171.25
6,277,534 B1 * 8/2001 Foltz ..... G03G 5/04 156/189
6,594,460 B1 7/2003 Williams et al.
7,204,584 B2 4/2007 Lean et al.
8,142,010 B2 3/2012 Ageishi
8,293,338 B2 10/2012 Castelli et al.
8,408,539 B2 4/2013 Moore
8,746,694 B2 * 6/2014 Moore ..... B41J 11/0095 271/262
8,840,241 B2 9/2014 Fletcher et al.
8,947,482 B2 2/2015 Ramesh et al.
8,998,403 B2 4/2015 Fletcher et al.
9,114,609 B1 8/2015 Folkins et al.
9,132,673 B2 9/2015 Fletcher et al.
9,211,736 B2 12/2015 Fletcher et al.
9,932,526 B2 4/2018 Rout
10,160,232 B1 12/2018 Griffin et al.
2011/0026990 A1 * 2/2011 Arimoto ..... G03G 15/2053 399/333
2011/0130498 A1 * 6/2011 Shinagawa ..... C08L 67/02 524/136
2012/0220680 A1 * 8/2012 Bastioli ..... C08G 63/183 521/182
2013/0023608 A1 * 1/2013 Kellett ..... D01F 1/10 524/52
2016/0041513 A1 * 2/2016 Takeda ..... G03G 15/2057 399/302

* cited by examiner

*Primary Examiner* — Howard J Sanders
(74) *Attorney, Agent, or Firm* — Bell & Manning, LLC

(57) ABSTRACT

An ink jet media transport that includes a polyalkylene furandicarboxylate layer substrate with a coating layer of a mixture of a conductive component and a polymer.

28 Claims, 3 Drawing Sheets

MEDIA TRANSPORTS

This disclosure is generally directed to media transports comprising a polyalkylene furandicarboxylate layer in contact with a layer comprising a mixture of a conductive component and a polymer.

BACKGROUND

A number of ink jet printing systems are known where there are selected, for example, aqueous inks and dye based inks. An ink jet ink can be comprised of deionized water, a water soluble organic solvent, and a colorant, such as a dye or a pigment, and where the inks can be selected for continuous ink jet systems and drop on demand ink jet processes inclusive of thermal ink jet, piezoelectric ink jet, and acoustic ink jet systems. These ink jet technologies can generate spherical ink droplets with, for example, a diameter of from about 15 μm (microns) to about 100 μm, that are directed toward a recording media at, for example, about 4 meters per second. Located within the ink jet print heads are ejecting transducers or actuators which produce the ink droplets. These transducers are typically controlled by a printer controller, or a conventional minicomputer, such as a microprocessor.

The printer controller can activate a plurality of transducers or actuators in relation to the movement of a recording media relative to an associated plurality of print heads. By controlling the activation of the transducers or the actuators, and the recording media movement, a printer controller should cause ink droplets to impact the recording media in a predetermined manner to thereby form an image on the recording media. An ideal droplet-on-demand type print head will produce ink droplets precisely directed toward a recording media, generally in a direction perpendicular thereto. However, a number of ink droplets may not be directed exactly perpendicularly to the recording media resulting in misdirected droplets that negatively affect the quality of a printed image.

Ink jet systems with media transports for the electrostatic tracking of media are illustrated in U.S. Pat. No. 9,132,673, the disclosure of which is totally incorporated herein by reference.

Several advantages have been reported for ink jet printing, such as the generation of quality images at high speeds and at relatively low costs. However, disadvantages relating to ink jet printing include the misdirection of ink droplets; retaining the media like paper upon which the ink droplets are directed in a flat configuration in the printing zone; the formation of friction induced triboelectric charges between the transport belt and the platen which can cause the generation of undesirable electrostatic fields in the ink ejection area that adversely affects print quality; the plugging of the ink jet nozzles; unacceptable image blooming; misalignment of the media transport rollers; failing to achieve the precise attachment of an aligned recording media onto the dielectric surface of a transport media thus preventing the accurate motion of the recording media relative to the print heads; consistent and controlled acceleration of the ink droplets to the transport media; undesirable media transport resistivity values, and the use of environmentally damaging materials that are selected for the media transporting system.

Certain imaging systems, like ink jet, contain as materials petroleum derived chemistry components, such as for example, polyethylene terephthalates (PET). Thus, desirable is the development of green materials, such as polymers that are bio-based, sometimes even biodegradable, that minimize the economic impacts and uncertainty associated with the reliance on petroleum imported from unstable regions, and that reduce the carbon footprint.

There is a need for ink jet printing processes and systems that substantially avoid or minimize the disadvantages illustrated herein.

Further, there is a need for environmentally acceptable ink jet media transports.

Also, there is a need for media transport belts that include thereon a media, such as a sheet of paper, that moves in a specific path, and which belts also retain the media in a flat configuration.

Additionally, there is a need for ink jet media transports that possess excellent mechanical properties, desirable glass transition temperatures, heat resistance characteristics, and acceptable modulus, especially as compared, for example, to the environmentally unfriendly polyethylene terephthalates media transports.

Still further there is a need for ink jet printing systems and processes that minimize the media, like paper, curl height that adversely impacts the print head operation when the media is in contact with the print head face plate.

There is also a need for media transports, such as a seamed belt, in contact with a platen supporting substrate, and where the belt contains a bio-based component.

Yet additionally, there is a need for media transports that include a bio-based component resulting in a reduction in the carbon footprint by, for example, about 50 percent.

Moreover, there is a need for a conductive, especially a partially conductive media transport to properly track a wide range size of media while avoiding a built up of friction induced electric fields.

Another need resides in the provision of a media transport that maintains the media registration at speed, is substantially impervious to aqueous inks and some alcohols, and eliminates or minimizes static fields.

Additionally, there is a need for media transport members that contain bio-based components that can be economically and efficiently manufactured, and where the amount of energy consumed is reduced.

Yet additionally, there is a need for ink jet media transports that possess excellent adhesion characteristics between a bio-based polymer supporting layer and a conductive coating mixture, especially as compared, for example, to the poorer adhesion properties for the environmentally unfriendly polyethylene terephthalates media transports.

These and other needs are believed to be achievable with the disclosed transport media systems and processes.

SUMMARY

Disclosed is an ink jet media transport comprising a polyalkylene furandicarboxylate layer substrate with a coating layer comprising, a mixture of a conductive component, and a polymer.

Also, disclosed is an ink jet media transport for ink jet printing comprising a bio-based polyethylene furandicarboxylate substrate with a coating layer comprising a mixture of a conductive component and a polymer.

Further, there is disclosed an ink jet media transport for ink jet printing comprising a bio-based polyethylene furandicarboxylate substrate with a coating layer comprising a mixture of a carbon black and a polyester, and wherein said coating layer mixture possesses a resistivity of from about $10^1$ Ω/square to about $10^6$ Ω/square as measured by a Resistance Meter.

Yet further there is disclosed an ink jet process comprising directing ink droplets onto a media transport that conveys a media sheet along a predetermined path where the sheet moves across a platen, and where ink jet printheads are present such that the faces thereof are mounted and fixed at a distance equal, for example, to about 1 millimeter or less than about 1 millimeter from the sheet, and where the sheet passes under the print heads, and further including a vacuum to assist for rendering the sheet in a flat configuration, and where the media transport comprises a polyalkylene furandicarboxylate layer in contact with a layer thereover comprising a mixture of a conductive component and a polymer.

FIGURES

The following Figures are provided to illustrate, for example, ink jet systems and media transports comprising a substrate, and thereover a partially conductive coating. In these Figures and with respect to the present disclosure, media refers, for example, to coated or uncoated papers, films, parchments, transparencies, plastics, fabrics, photofinishing papers, and the like, upon which information including text, images, or both can be reproduced.

Illustrated in FIG. 1 is a side elevational view of an ink jet printing system.

EMBODIMENTS

Figure 1:
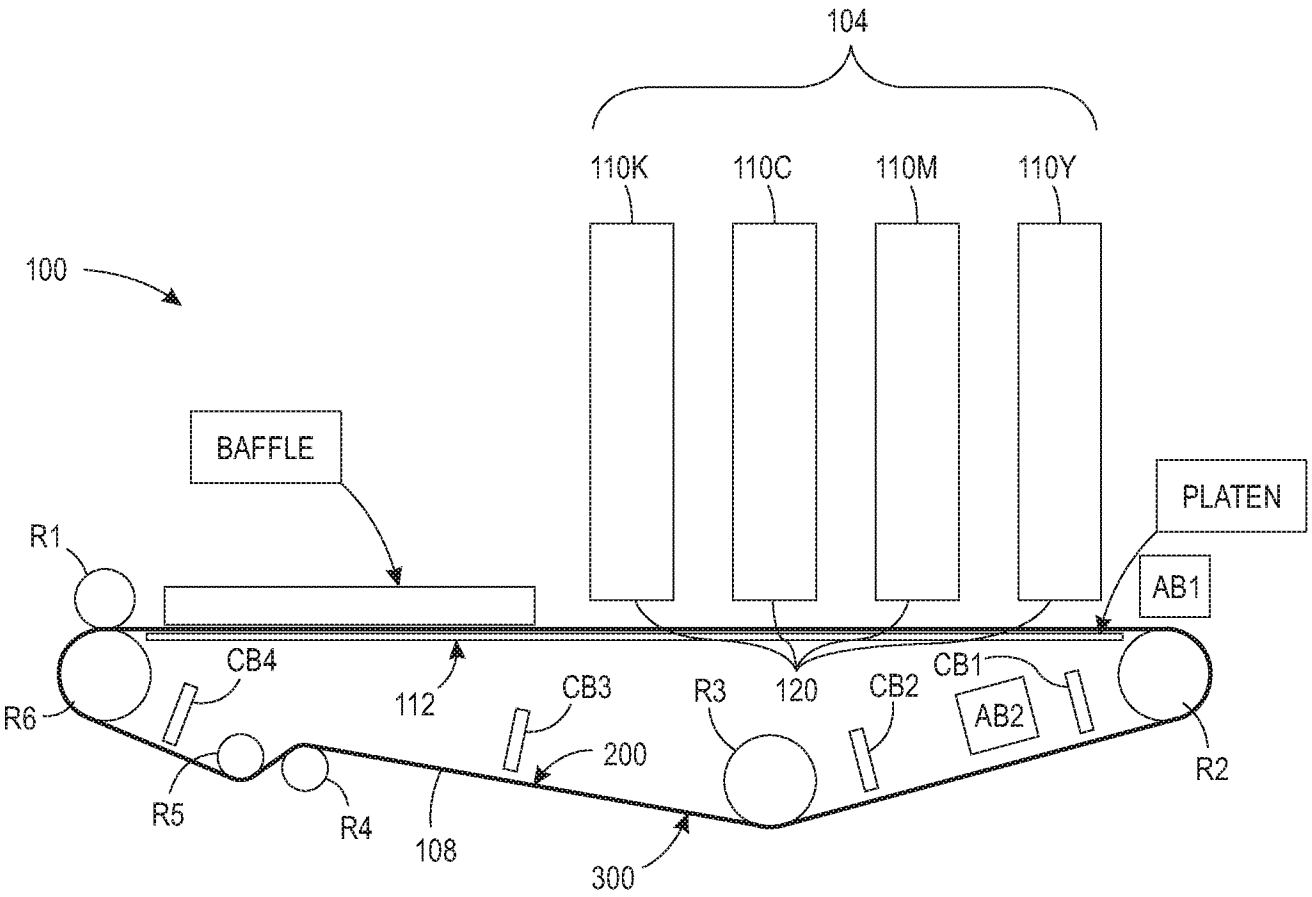

There is illustrated in FIG. 1 a high-speed ink jet system 100 that includes a media transport containing thereon a media like a sheet of paper, and moving the media to a conventional print zone 104. The ink jet containing media transport system 100 includes a seamed or seamless smooth surfaced belt 108 in a secured contact with electrically grounded rollers R1 to R6, where at least one roller is operably connected to a motor, not shown, to drive the belt 108, for causing media that is on the belt 108 to be transported, that is for example, moved from left to right, relative to FIG. 1, through the print zone 104. In the print zone 104, there are illustrated ink jet print heads, represented by an exemplary black ink print head 110K, an exemplary cyan ink print head 110C, an exemplary magenta ink print head 110M, and an exemplary yellow ink print head 110Y. Each of the ink jet print heads 110K, 110C, 110M and 110Y includes its own face plate 120, closely spaced to the belt 108, for precisely jetting ink onto media that is carried by belt 108 through the print zone 104.

Belt 108, whether seamed or seamless, where seamless belts can be generated by know methods, reference for example U.S. Pat. No. 6,106,762, the disclosure of which is totally incorporated herein by reference, is formed as an endless loop as illustrated in FIG. 1. The endless loop is configured to be in contact with at least the rollers R2, R3, R5 and R6, with each of the rollers including a rubber coating, not shown, to electrically isolate each of the rollers from the inner surface 200 of the media transport belt 108, with the outer surface or exterior surface of the belt 108 being designated as 300.

During operation of the system 100, the engagement of belt 108 enables media like paper, not shown, placed on the belt 108 to move toward the print zone 104 where tiny droplets of ink are sprayed onto the media in a controlled manner for the purpose of printing a desired image or text onto the media passing by. The ink jet print heads are mounted such that their faces, where ink nozzles are located, are spaced at, for example, about 1 millimeter or less from the media surface. Since media, such as paper, may possess a curl property that lifts at least a portion of the media more than, for example, at least about 1 millimeter above the surface of transport belt 108, minimizing or avoiding contact between the media to one of the print heads in print zone 104 can be desirable, and is achievable by, for example, known decurling devices.

With further reference to FIG. 1, there is provided a vacuum plenum at the upper surface of platen 112, such as glass or a metal. Vacuum plenums, which refer, for example, to a chamber where a negative pressure, that is air pressure that is below atmospheric pressure, is applied, are known, reference for example, U.S. Pat. No. 8,408,539, the disclosure of which is totally incorporated herein by reference. The platen 112 is usually electrically conductive, and presents a flat surface or supporting substrate against which the media transport belt 108 is positioned. The vacuum plenum that has platen 112 as its upper surface includes a plurality of conventional slots, not shown, over which the media transport belt 108 passes, and where the slots enable the vacuum plenum portion of platen 112 to subject the media transport belt 108 to a vacuum.

To control, that is increase or decrease the 108 belt tension, and to minimize unnecessary drag to the belt, there can be increased the spacing between the rollers, like rollers R2 and R6, and this also assists in maintaining the desired registration speed of the media transport belt.

Figure 2:
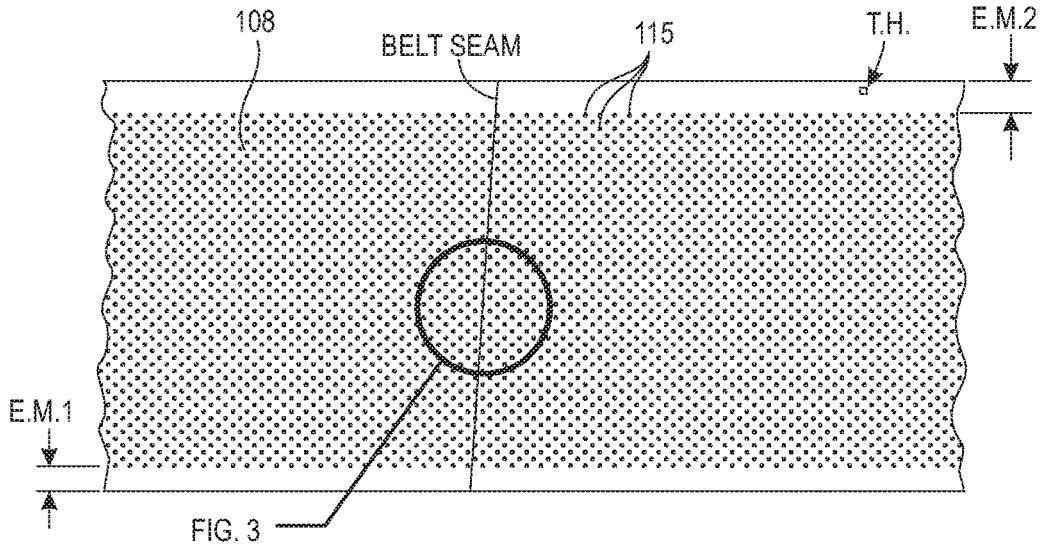
FIG. 2 illustrates a seamed transport belt.

Additionally, the media transport belt 108 may be totally, that is 100 percent opaque, to for example, avoid interference with a belt speed sensing device, not shown, that determines and controls the speed, from left to right relative to FIG. 1, of the media at, for example, from about 0.5 meter to about 2 meters per second. The sensing device is typically located beneath a timing hole (T.H.) with sensing being accomplished through the edge margin E.M.1 and E.M.2 of belt 108. (FIG. 2).

Also, shown in FIG. 1 is a conventional baffle, which primarily functions to provide a vacuum to the media intake area when media like paper is not present on belt 108. Further, roller R1 can be located adjacent to roller R6 to form a nip therebetween, to catch sheets of media in the nip, and thereafter to force each sheet of media onto the exterior surface 300 of media transport belt 108, to enable media transport belt 108 to transport media from the nip to print zone 104. A region immediately to the left of rollers R1 and R6 (FIG. 1) may be referred to as a media-uptake zone.

The inner surfaces 200 of the media transport belt 108, shown in FIG. 1, are in rolling contact with each of the rollers R2, R3, R5 and R6. Straddling media transport belt 108 are two spaced-apart conventional active antistatic bars, AB1 and AB2, and a plurality of conventional commercially available passive carbon brushes, CB1, CB2, CB3 and CB4, shown arranged in a known manner along the inner surface 200 of media transport belt 108, to dissipate any induced, static, or other charges that might build up or be present on the inner surface 200 of media transfer belt 108. In the side evaluation the media transport system belt 108 of FIG. 1, the rollers R4 and R5 are positioned in their normally spaced relationship when belt 108 is mounted on the rollers R2, R3, R5 and R6 with roller R1 also assisting in directional movement of the belt 108.

Roller R4, shown in FIG. 1 as being in rolling contact with exterior surface 300 of the media transport belt 108, can in embodiments be designed to be electrically conductive by providing it with an electrically conductive steel exterior surface to assist in dissipating charge from exterior surface 300.

In FIG. 2, which is a fragmented view of an exemplary embodiment of a media transport belt that appears on edge in FIG. 1, on an enlarged scale relative to FIG. 1, there is illustrated a seamed belt 108 with a belt seam, and with T.H. representing a timing hole, and where E.M.1 represents edge margins, E.M.2 represents edge margins, and 115 represents perforations. Therefore, media curling is minimized in that the media transport belt is prepared to include a plurality of holes, perforations, or apertures extending substantially across its width, as shown in FIG. 2, leaving the edge margins E.M.1 and E.M.2 to be free of apertures for enabling the vacuum plenum located beneath belt 108 to cause media to be drawn to belt 108. Each individual aperture pattern is generally circular, and has a diameter of, for example, from about 1 millimeter to about 2 millimeters, where the pattern can form a square, and where the apertures have spacings 111 of, for example, from about 6 millimeters to about 6.50 millimeters between centers, as shown in FIG. 3.

Figure 3:
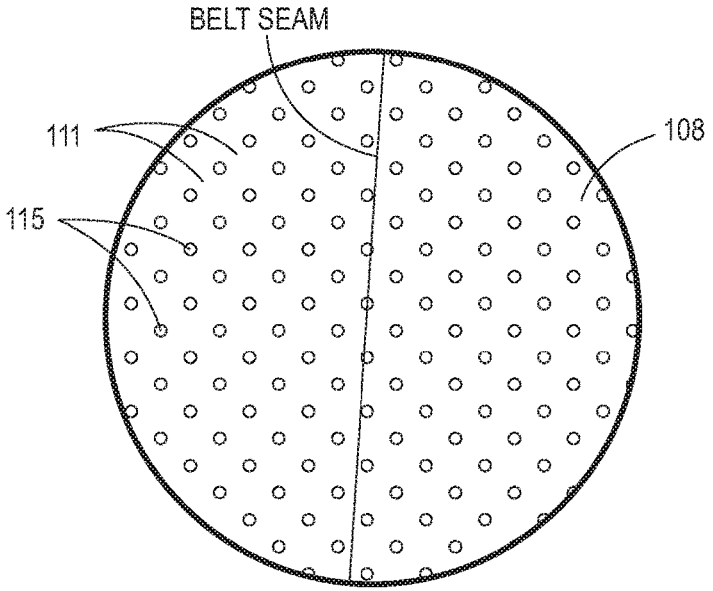
FIG. 3 illustrates an embodiment of the media transport belt shown in FIG. 2.

FIG. 3 represents an enlarged media transport belt 108, with a belt seam, spaces 111, and perforations 115.

Figure 4:
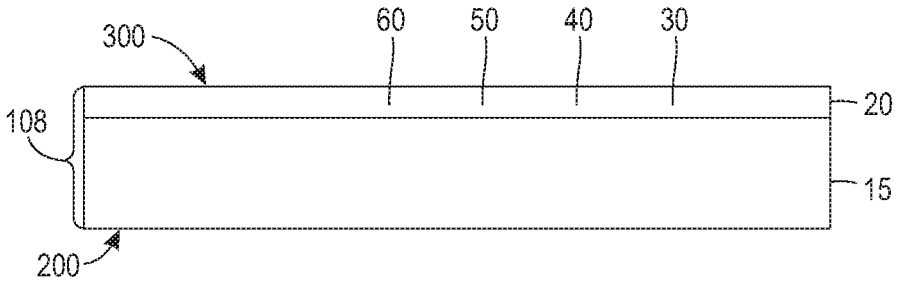
FIG. 4 illustrates a side elevational view of an exemplary embodiment of a media transport.

FIG. 4 illustrates a side elevational view of an exemplary two-layer embodiment of belt 108, on an enlarged scale relative to FIG. 1, and where the belt 108 comprises a supporting polyalkylene furandicarboxylate substrate 15, and a conductive, especially partially conductive layer 20, which possesses a surface resistivity of, for example, from about $10^1$ Ω/square to about $10^6$ Ω/square, or from about $10^3$ Ω/square to about $10^5$ Ω/square, and which resistivity can be measured by a known Resistance Meter; media belt surface 200, media belt surface 300, polymers 30, optional conductive components or fillers 40, optional plasticizers 50, and optional leveling agents 60.

Figure 5:
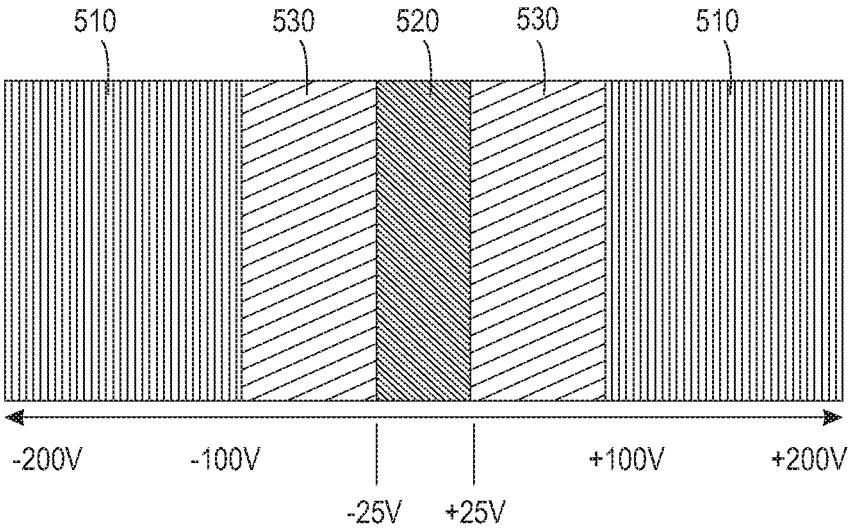
FIG. 5 illustrates the media transport nozzle plate misting versus electric field strengths.

FIG. 5 illustrates the effects of certain ranges of electric field strengths, measured on the belt at various temperature and humidity conditions, based on the video recordings generated on commercially available high-speed recording equipment, where 510 represents a zone with electric field voltages V that ranged from a positive or a negative about 100 to about 200 volts that results in nozzle plate misting. Reference numeral 530 represents an intermediate zone with positive or negative electric field voltages V that range from about 25 to about 100 volts resulting in poor misting. Reference numeral 520, where field voltages V were from about a minus or negative 25 volts to about a plus or positive 25 volts substantially eliminated, or reduced face plate contamination, and substantially eliminated the redepositing of the mist containing particles.

Media Transport Components

The media transport comprises, for example, a transport belt, inclusive of a seamed vacuum transport belt, or a transport belt free of seams, and further including a platen for supporting the belt. In embodiments, the disclosed belt comprises a conductive coating, or partially conductive coating in contact with a polyalkylene furandicarboxylate substrate, and where the coating comprises a polymer, such as a polyester and a conductive component, and which coating also includes as optional components at least one plasticizer and at least one leveling agent.

Polymer Examples

Various mixtures of at least one conductive component and at least one polymer can be selected for the disclosed media transport member coatings, such as those members in the configuration of a belt.

Examples of polymers that can be selected for the coating mixture include thermoplastics, polycarbonates, polysulfones, polyesters, such as aliphatic polyesters of, for example, polyglycolic acids, polylactic acids, and polycaprolactones, and aliphatic copolyesters, such as polyethylene adipates and polyhydroxyalkanoates. Specific examples of polyesters selected for the transport media coating mixture or layer are, for example, VITEL® 1200B ($T_g$=69° C., $M_w$=45,000, a copolyester prepared from ethylene glycol, diethylene glycol, terephthalic acid, and isophthalic acid), 3300B ($T_g$=18° C., $M_w$=63,000), 3350B ($T_g$=18° C., $M_w$=63,000), 3200B ($T_g$=17° C., $M_w$=63,500), 3550B ($T_g$=11° C., $M_w$=75,000), 3650B ($T_g$=−10° C., $M_w$=73,000), 2200B ($T_g$=69° C., $M_w$=42,000, a copolyester prepared from ethylene glycol, diethylene glycol, neopentyl glycol, terephthalic acid, and isophthalic acid), and 2300B ($T_g$=69° C., $M_w$=45,000), all available from Bostik Incorporated headquartered in Milwaukee, Wis.

Examples of polyesters 30, included in the coating mixture, include aromatic polyester copolymers, such as VITEL® 1200B (Tg=69° C.; $M_w$=45,000), 3300B (Tg=18° C.; $M_w$=63,000, a co-polyester prepared from ethylene glycol, diethylene glycol, terephthalic acid, and isophthalic acid), 3350B (Tg=18° C.; $M_w$=63,000), 3200B (Tg=17° C.; $M_w$=63,500), 3550B (Tg=minus 11° C.; $M_w$=75,000), 3650B (Tg=minus 10° C.; $M_w$=73,000), 2200B (Tg=69° C.; $M_w$=42,000, a co-polyester prepared from ethylene glycol, diethylene glycol, neopentyl glycol, terephthalic acid, and isophthalic acid), and 2300B (Tg=69° C.; $M_w$=45,000), all these polyesters being commercially available from Bostik Incorporated headquartered in Milwaukee, Wis.

The disclosed glass transition temperatures ($T_g$) can be determined by a number of known methods, and more specifically, such as by Differential Scanning calorimetry (DSC). For the disclosed molecular weights, such as $M_w$ (weight average) and $M_n$ (number average), they can be measured by a number of known methods, and more specifically, by Gel Permeation Chromatography (GPC).

The polymer can be present in the mixture in a number of differing effective amounts, such as for example, from about 30 weight percent to about 99 weight percent, in those situations when other optional components, such as plasticizers and leveling agents may not be present, from about 60 weight percent to about 97 weight percent, from about 70 weight percent to about 95 weight percent, from about 75 weight percent to about 92 weight percent, or from about 80 weight percent to about 87 weight percent of the total solids, and providing the total percent of components present is about 100 percent.

Conductive Component Examples

Examples of conductive components selected for the coating mixture include known carbon forms like carbon black, graphite, carbon nanotube, fullerene, graphene, and the like; metal oxides, mixed metal oxides, and mixtures thereof; polymers that have conductive characteristics, such as polyaniline, polythiophene, polypyrrole, mixtures thereof, and the like.

Examples of carbon black conductive components that can be selected for incorporation into the media transport coating layer illustrated herein include KETJENBLACK® carbon blacks, available from AkzoNobel Functional Chemicals, Special Black 4 (B.E.T. surface area=180 $m^2$/g, DBP absorption=1.8 ml/g, primary particle diameter=25 nanometers), available from Evonik-Degussa, Special Black 5 (B.E.T. surface area=240 $m^2/g$, DBP absorption=1.41 ml/g, primary particle diameter=20 nanometers), Color Black FW1 (B.E.T. surface area=320 $m^2/g$, DBP absorption=2.89 ml/g, primary particle diameter=13 nanometers), Color Black FW2 (B.E.T. surface area=460 $m^2/g$, DBP absorption=4.82 ml/g, primary particle diameter=13 nanometers), Color Black FW200 (B.E.T. surface area=460 $m^2/g$, DBP absorption=4.6 ml/g, primary particle diameter=13 nanometers), all available from Evonik-Degussa; VULCAN® carbon blacks, REGAL® carbon blacks, MONARCH® carbon blacks, EMPEROR® carbon blacks, and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), EMPEROR® 1200, EMPEROR® 1600, VULCAN® XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); special carbon blacks available from Evonik Incorporated; and Channel carbon blacks, available from Evonik-Degussa. Other known suitable carbon blacks not specifically disclosed herein may be selected as the conductive component.

Examples of polyaniline conductive components that can be selected for incorporation into the coating mixture are PANIPOL™ F, commercially available from Panipol Oy, Finland; and known lignosulfonic acid grafted polyanilines. These polyanilines usually have a relatively small particle size diameter of, for example, from about 0.5 micron to about 5 microns; from about 1.1 microns to about 2.3 microns, or from about 1.5 microns to about 1.9 microns.

Metal oxide conductive components that can be selected for the disclosed coating mixture include, for example, tin oxide, antimony doped tin oxide, indium oxide, indium tin oxide, zinc oxide, titanium oxide, mixtures thereof, and the like. Mixed metal oxides include, for example, tin oxide and antimony doped tin oxide, tin oxide and indium oxide, tin oxide and zinc oxide, antimony doped tin oxide and indium tin oxide, zinc oxide and titanium oxide, titanium oxide and tin oxide, antimony doped tin oxide, zinc oxide and titanium oxide, indium oxide, titanium oxide, and tin oxide, antimony doped tin oxide, indium oxide, and titanium oxide, mixtures thereof, and the like.

The conductive component amount is, for example, from about 1 weight percent to about 70 weight percent, from about 3 weight percent to about 40 weight percent, from about 5 weight percent to about 30 weight percent, from about 8 weight percent to about 25 weight percent, or from about 13 weight percent to about 20 weight percent of the total solids, and providing the total percent of solids present is about 100 percent.

The conductive layer mixture or coating layer can be included in a number of thicknesses, such as for example from about 0.1 micron to about 50 microns, from about 1 micron to about 40 microns, from about 5 microns to about 30 microns, or from about 10 microns to about 15 microns.

The conductive layer mixture or coating layer can be included in a number of thicknesses, such as for example from about 0.1 micron to about 50 microns, from about 1 micron to about 40 microns, from about 5 microns to about 30 microns, or from about 10 microns to about 15 microns.

Optional Plasticizers

Optional plasticizers that primarily function to increase the plasticity or fluidity of a material, like the polymer selected for the disclosed media transport member conductive coating mixture, include diethyl phthalate (DEP), dioctyl phthalate, diallyl phthalate, polypropylene glycol dibenzoate, di-2-ethyl hexyl phthalate, diisononyl phthalate, di-2-propyl heptyl phthalate, diisodecyl phthalate, di-2-ethyl hexyl terephthalate, other known suitable plasticizers, mixtures thereof, and the like. The plasticizers, which can be present in various effective amounts, such as for example, from about 0.1 weight percent to about 30 weight percent, from about 1 weight percent to about 20 weight percent, or from about 3 weight percent to about 15 weight percent based on the solids, and providing that the total amount of solids present is equal to about 100 percent.

Optional Leveling Agents

Optional leveling agent examples selected for the coating mixture media transport members, which agents can contribute to the smoothness characteristics, such as enabling smooth coated surfaces with minimal or no blemishes or protrusions of the members illustrated herein include, for example, polysiloxane polymers. The optional polysiloxane polymers selected include, for example, a polyester modified polydimethylsiloxane with the tradename of BYK® 310 (about 25 weight percent in xylene) and BYK® 370 (about 25 weight percent in xylene/alkylbenzenes/cyclohexanone/monophenylglycol=75/11/7/7); a polyether modified polydimethylsiloxane with the tradename of BYK® 333, BYK® 330 (about 51 weight percent in methoxypropylacetate) and BYK® 344 (about 52.3 weight percent in xylene/isobutanol=80/20), BYK®-SILCLEAN 3710 and 3720 (about 25 weight percent in methoxypropanol); a polyacrylate modified polydimethylsiloxane with the tradename of BYK®-SILCLEAN 3700 (about 25 weight percent in methoxypropylacetate); or a polyester polyether modified polydimethylsiloxane with the tradename of BYK® 375 (about 25 weight percent in di-propylene glycol monomethyl ether), all commercially available from BYK Chemical of Wesel, Germany, mixtures thereof, and the like. The leveling agents for the conductive coating mixture are selected in various effective amounts, such as for example, from about 0.01 weight percent to about 5 weight percent, from about 0.1 weight percent to about 3 weight percent, and from about 0.2 weight percent to about 1 weight percent based on the solids present, and providing that the total amount of solids present is equal to about 100 percent.

Optional Silicas

Optional silica examples present in the disclosed media transport member coating mixture, and which silicas can contribute to the wear resistant properties of the member include silica, fumed silicas, surface treated silicas, other known silicas, such as AEROSIL R972®, mixtures thereof, and the like. The silicas are selected in various effective amounts, such as for example, from about 0.1 weight percent to about 20 weight percent, from about 1 weight percent to about 15 weight percent, and from about 2 weight percent to about 10 weight percent based on the solids, and providing that the total amount of solids present is equal to about 100 percent.

Optional Fluoropolymer Particles

Optional fluoropolymer particles selected for the disclosed conductive mixture media transport member, and which particles can contribute to the wear resistant properties of the members illustrated herein, include tetrafluoroethylene polymers (PTFE), trifluorochloroethylene polymers, hexafluoropropylene polymers, vinyl fluoride polymers, vinylidene fluoride polymers, difluorodichloroethylene polymers, or copolymers thereof. The fluoropolymer particles are selected in various effective amounts, such as for example, from about 0.1 weight percent to about 20 weight percent, from about 1 weight percent to about 15 weight percent, and from about 2 weight percent to about 10 weight percent based on the solids, and providing that the total amount of solids present is equal to about 100 percent.

Substrate Examples

The disclosed media transport, such as a media belt that functions primarily as a supporting substrate for the disclosed coating mixture, comprises at least one of a polyalkylene furandicarboxylate, such as a bio-based polyalkylene furandicarboxylate generated, for example, from renewal sources, where alkylene contains, for example, from about 1 carbon atom to about 50 carbon atoms, from about 2 carbon atom to about 18 carbon atoms, from about 2 carbon atoms to about 12 carbon atoms, from about 2 carbon atoms to about 6 carbon atoms, or from about 5 carbon atoms to about 25 carbon atoms.

Examples of polyalkylene furandicarboxylates include polyethylene furandicarboxylate (PEF), polyethylene 2,5-furandicarboxylate, polypropylene furandicarboxylate (PPF), polybutylene furandicarboxylate (PBF), polyalkylene furancarboxylates copolymers of polyethylene furandicarboxylate terephthalate, polypropylene furandicarboxylate terephthalate, polybutylene furandicarboxylate terephthalate, mixtures thereof, and the like, all believed to be available from Avantium Research Institute of Amsterdam Netherlands, and Toyobo Company Ltd. of Japan, and also available from the joint efforts of Avantium Research Institute of Amsterdam Netherlands and Toyobo Company Ltd. of Japan, and from the Stanford University Labs, or prepared as disclosed herein.

It is believed that the disclosed polyalkylene furandicarboxylates (PEF), inclusive of bio-based polyalkylene furandicarboxylates, can be prepared as illustrated in the *Journal of Energy and Environmental Science Issue* 4, 2012 titled "*Replacing Fossil Based PET with Bio-based PEF*", listed authors A.J.J.E. Eerhart, and M. K. Patel, the disclosure of which is totally incorporated herein by reference; *European Polymer Journal, Volume* 83, October 2016, Pages 202-229, listed authors of George Z Papageorgiou, Dimitrios G. Papageorgiou, Zoi Terzopoulou, and Dimitrios N. Bikiaris, the disclosure of which is totally incorporated herein by reference; and *Nature* 531, *News and Views, "Sustainable Chemistry: Putting Carbon Dioxide to Work*", Mar. 9, 2016, listed author Eric J. Beckman, the disclosure of which is totally incorporated herein by reference. Compared with known polyethylene terephthalate (PET) substrates, polyalkylene furandicarboxylates, such as polyethylene furandicarboxylates, can be prepared from 100 percent renewable sources, from substances derived from living or once-living organisms, such as renewable domestic agricultural products like plants, animal and marine substances, or forestry substances including biomass mixtures, soybeans, corn, flax, jute, and the like thus permitting a reduction in the carbon footprint by at least 50 percent.

In a known specific process to obtain PEF, fructose derived from plants is converted by way of a four-step process to furan-2,5-dicarboxylic acid (FDCA), which can then be reacted with ethylene glycol. The FDCA can also be prepared by reacting 2-furan carboxylate (FC) with carbon dioxide in the presence of cesium carbonate ($Cs_2CO_3$).

The polyalkylene furandicarboxylate substrate can be of a number of different thicknesses, such as from about 25 microns to about 250 microns, from about 25 microns to about 150 microns, about 50 microns to about 125 microns, or from about 75 microns to about 150 microns, and where the total thickness of the belt is, for example, from about 1 to about 10 mils, from about 1 to about 8 mils, from about 1 mil to about 5 mils, from about 2 mils to about 4 mils, and more specifically, about 3.8 mils, measured by known means such as a Permascope.

A polyalkylene furandicarboxylate polymer, such as polyethylene furan-2,5-dicarboxylate selected for the media transport coating mixture supporting substrate, can be represented by the following formula/structure

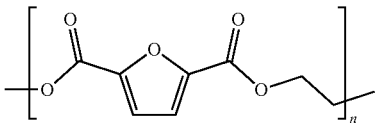

with n representing the number of repeating segments, and which n can be, for example, of a value of from about 50 to about 1,500, from about 100 to about 800, or from about 100 to about 500.

Media Transport Preparation

The media transport in the form of a sheet can be converted into, for example, a media transport belt by a number of suitable processes, such as by known welding processes. For example, an elongated strip of the media belt material, in various suitable sizes, which belt is comprised of the coating mixture illustrated herein supported by the polyalkylene furandicarboxylate substrate illustrated herein, was cut longitudinally along opposite edge margins of the belt material, to produce an about 455±2 millimeters wide elongated strip followed by slitting longitudinally along opposite edge margins of the strip, to produce an about 440±2 millimeters wide coated elongated strip of belt material, and after removal of the coating from the edge margins of the elongated strip of the belt material, there can be generated uncoated edge margins as shown in FIG. 2. The elongated strip of belt material can then be formed into a loop by bringing the opposite end portions of the elongated strip of belt material together in an overlap fashion.

Thereafter, with a commercially available edge offset reduction system of a high resolution camera, the output of which provides feedback control to a motor that adjusts the edge margins of the endless looped belt such that they do not greatly vary from each other relative to a longitudinal centerline by more than about 300±2 μm (micrometers), can be used to minimize any endless loop irregularities, such as conicity, that is any conic shaped irregularity throughout the entire circumference of the belt.

Subsequently, the overlapped end portions of the belt are permanently joined via ultrasonic welding to produce a seamed belt, also characterized as a closed circular loop, measuring, for example, about 655±2 millimeters in diameter by about 440±2 millimeters wide. There can be selecting for the welding process commercially available Branson ultrasonic welding equipment, which permits the continuously joining of the opposite end portions of the media transport belt to produce an overlapped seam. Specifically, to facilitate joining together the two ends of the substrate of, for example, substrate 15, coating material trapped between end layers of the substrate material can be heated to a liquid state during the welding process, and forced out of the overlap area thereby resulting in an excellent weld. The seam break strength as measured by an Instron Universal Tester can be greater than about 50 pounds per inch, and more specifically, from about 75 pounds per inch to about 125 pounds per inch. Any materials forced out from the overlap weld area can then be removed from the belt.

A timing hole (see FIG. 2) with a belt speed sensing device located beneath the hole to control the linear speed of media transport can be formed through the edge margins of the belt. There can also be provided in the disclosed ink jet systems a combination of position sensors designed to provide feedback to a motorized cam that controls a steering roller in the belt to provide a high-speed inkjet printer with highly accurate motion and location registration.

In addition, the media-transport belt 108 should be totally opaque, so as to not interfere with a belt speed sensing device located beneath a timing hole ("T.H."), and be able to sense through an edge margin of belt 108 (FIG. 2). Also, media transport belt 108 should be of a construction that substantially eliminates generation of a static field since which during operation of system 100 sheets of media travel at speeds of, for example, 1 meter per second, resulting in control of the linear speed of media transport belt 108.

Perforating the Seamed Transport Media in a Predefined Pattern

The seamed transport media, such as in the configuration of a belt, can be perforated, that is apertures or holes formed therein entirely through the belt in a predetermined pattern by, for example, EM/Belting Industries, resulting in a belt 108 shown, for example, in FIGS. 2 and 3.

Specific embodiments will now be described in detail. These examples are intended to be illustrative, and are not limited to the materials, conditions, or process parameters set forth in these embodiments.

Example I

There was prepared a seamed vacuum transport media belt as follows:

Two carboys or containers are filled with a total of 28 pounds (lbs.) of stainless steel shot and EMPEROR® 1200, BYK® 333, diethyl phthalate, and methylene chloride as illustrated in the following table, followed by mixing/milling for eight hours. The resulting two container contents were merged to form the mill base, which was then added to pressure pot and let down with a 10 VITEL® 1200B/methylene chloride solution, resulting in the final coating composition of EMPEROR® 1200/VITEL®1200B/BYK®333/diethyl phthalate with a ratio of 47.4/47.4/0.5/4.7 in methylene chloride, about 11.94 percent solids.

TABLE

| COMPONENT | MASS (LB.) |
|---|---|
| EMPEROR ® 1200 (conductive carbon black) | 3.65 |
| VITEL ® 1200B (polyester copolymer) | 3.65 |
| Methylene Chloride (solvent) | 56.49 |
| Diethyl Phthalate (plasticizer) | 0.37 |
| BYK ® 333 (leveling agent) | 0.037 |

The above prepared coating dispersion was then coated, via extrusion, onto a 4 mil thick bio-based generated polyethylene furan-2,5-dicarboxylate substrate layer (PEF), and then subsequently dried at 266° F. for 3 to 4 minutes. The coating resulting was about 10 to about 15 microns in thickness as can be determined by a Permascope and possesses a surface resistivity of about $1.0\times10^4$ Ω/square as measured with a known Trek Model 152-1 Resistance Meter.

The above prepared belt sheet, while in roll form, was ultrasonically welded into a belt/loop that measures about 655 millimeters in diameter and was about 440 millimeters wide. The welding process was accomplished with Branson ultrasonic welding equipment to continuously join the overlapped seam. The process parameters were designed to remove any coating in the overlap areas to facilitate the joining of the two ends of the belt sheet together such that the seam break strength as measured by Instron Universal Tester was greater than about 50 lbs/in. The material that is squeezed out the ends of the seam was removed, and a timing hole was added.

Alternatively, the aforementioned steps can be combined with a high tolerance material slitting of the media transport sheet, and an edge offset reduction vision system can be used during the overlap process so that the loop's edge do not vary by more than about 300 μm throughout its circumference, resulting in an active steering system to produce a highly accurate motion/location registration of the transport belt.

The prepared seamed belt was then perforated in a predefined pattern by OEM/Belting Industries, see for example, FIG. 2.

It is believed that ink jet machine laboratory testing at ambient conditions will show a decrease in static field voltage on the coated surface of the belt from an average of about 250 volts to about 25 volts, no noticeable misting of printhead faceplates after about 5,000 cycles at about 50° F. and 20 percent relative humidity, and the absence of droplets returning to contaminate the inkjet faceplates.

The claims, as originally presented and as they may be amended, encompass variations, alternatives, modifications, improvements, equivalents, and substantial equivalents of the embodiments and teachings disclosed herein, including those that are presently unforeseen or, unappreciated, and that, for example, may arise from applicants/patentees and others. Unless specifically recited in a claim, steps or, components of claims should not be implied or, imported from the specification or, any other claims as to any particular order, number, position, size, shape, angle, color, or, material.

What is claimed is:

1. An ink jet media transport belt comprising a polyalkylene furandicarboxylate substrate layer having a surface and a coating layer on the surface of the polyalkylene furandicarboxylate substrate layer, the coating layer comprising a mixture of a conductive component and a polymer.

2. The belt of claim 1 wherein said conductive component is selected from the group consisting of carbon black, graphite, carbon nanotubes, fullerene, graphene, metal oxides, mixed metal oxides, and mixtures thereof.

3. The belt of claim 1 wherein said polyalkylene furandicarboxylate is bio-based polyethylene furandicarboxylate.

4. The belt of claim 1 wherein the belt exhibits a surface resistivity of from about $10^1$ Ω/square to about $10^6$ Ω/square as measured by a Resistance Meter.

5. The belt of claim 1 wherein said coating layer is of a thickness of from about 5 microns to about 30 microns.

6. The belt of claim 1 wherein said substrate layer is of a thickness of from about 25 microns to about 150 microns.

7. The belt of claim 1 wherein said polyalkylene furandicarboxylate substrate layer is in direct contact with said coating layer.

8. The belt of claim 1 wherein said polyalkylene furandicarboxylate is polyethylene furandicarboxylate.

9. The belt of claim 1 wherein said conductive component is carbon black.

10. An ink jet media system comprising the belt of claim 1, and further comprising a print zone, a plurality of ink jet print heads with face plates, a reservoir that supplies ink compositions to said ink jet print heads, rollers in contact with the belt, an ink jet sensor, and a vacuum plenum in contact with a platen.

11. The belt of claim 1 wherein the belt is a seamed belt.

12. The belt of claim 1 wherein said alkylene of the polyalkylene furandicarboxylate substrate layer contains from 2 carbon atoms to about 18 carbon atoms.

13. The belt of claim 1 wherein said polyalkylene furandicarboxylate has the following Formula

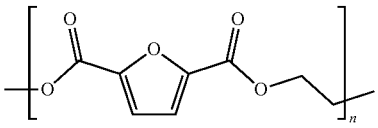

where n represents the number of repeating segments, and is from about 50 to about 1,500.

14. The belt of claim 13 wherein said n is from about 100 to about 500.

15. The belt of claim 1 wherein said polymer is a polyester.

16. The belt of claim 1 wherein said polyalkylene furandicarboxylate is a copolymer selected from the group consisting of polyethylene furandicarboxylate terephthalate, polypropylene furandicarboxylate terephthalate, and polybutylene furandicarboxylate terephthalate.

17. The belt of claim 1, wherein the polyalkylene furandicarboxylate is polyethylene furandicarboxylate, the conductive component is carbon black, and the polymer is a polyester.

18. The belt of claim 17, wherein the polyethylene furandicarboxylate has the following Formula

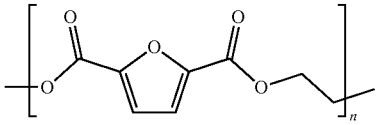

where n represents the number of repeating segments, and is from about 50 to about 1,500.

19. The belt of claim 18, wherein the polyester is a copolyester of ethylene glycol, diethylene glycol, terephthalic acid and isophthalic acid.

20. The belt of claim 1, wherein the coating layer comprises from about 30 weight percent to about 70 weight percent of the conductive component and from about 30 weight percent to about 70 weight percent of the polymer.

21. The belt of claim 20, wherein the polyalkylene furandicarboxylate is polyethylene furandicarboxylate, the conductive component is carbon black, and the polymer is a polyester.

22. The belt of claim 21, wherein the polyethylene furandicarboxylate has the following Formula

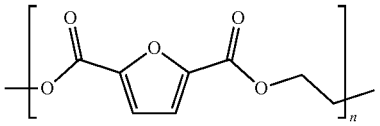

where n represents the number of repeating segments, and is from about 50 to about 1,500.

23. The belt of claim 22, wherein the polyester is a copolyester of ethylene glycol, diethylene glycol, terephthalic acid and isophthalic acid.

24. The belt of claim 20, wherein the conductive component and the polymer are present at about the same amount.

25. The belt of claim 1, wherein the coating layer consists of the conductive component; the polymer; optionally, a plasticizer; and optionally, a leveling agent.

26. The belt of claim 25, wherein the belt consists of the substrate layer and the coating layer.

27. The belt of claim 17, wherein the coating layer consists of the conductive component; the polymer; optionally, a plasticizer; and optionally, a leveling agent.

28. The belt of claim 20, wherein the coating layer consists of the conductive component; the polymer; optionally, a plasticizer; and optionally, a leveling agent.

* * * * *